United States Patent [19]

Mohnhaupt

[11] 4,105,418

[45] Aug. 8, 1978

[54] FUELS FOR INTERNAL COMBUSTION ENGINES

[76] Inventor: Dietrich Fritz Arthur Mohnhaupt, En Cardelay, 1261 Bassins, Switzerland

[21] Appl. No.: 588,066

[22] Filed: Jun. 18, 1975

Related U.S. Application Data

[63] Continuation of Ser. No. 364,253, May 29, 1973, abandoned.

[51] Int. Cl.[2] ..... C10L 1/18

[52] U.S. Cl. ..... 44/78; 44/71; 44/72

[58] Field of Search ..... 44/78, 71, 72

[56] References Cited

U.S. PATENT DOCUMENTS

| | | | |
|---|---|---|---|
| 2,786,745 | 3/1957 | Stayner et al. | 44/77 |
| 2,930,681 | 3/1960 | Barusch | 44/78 |
| 3,615,295 | 10/1971 | Manary | 44/78 |

OTHER PUBLICATIONS

Becher, Emulsion-Theory-Practice, 2nd Ed. 1965, pp. 212, 213, 232-234, 238-249.

Rohm & Haas, "Triton Alkyl Phenol Surfactants", Mar. 1966, pp. 4-7.

*Primary Examiner*—Arthur P. Demers

*Attorney, Agent, or Firm*—Ostrolenk, Faber, Gerb & Soffen

[57] ABSTRACT

A liquid fuel for internal combustion engines allowing better combustion and increased purity of exhaust gases, especially in terms of CO concentration and freedom from unburned or only partially burned hydrocarbons. The fuel is a conventional hydrocarbon based fuel, like gasoline and diesel oil, containing at least one additive which reduces the surface tension of the liquid fuel.

10 Claims, No Drawings

FUELS FOR INTERNAL COMBUSTION ENGINES

This is a continuation of application Ser. No. 364,253, filed May 29, 1973, now abandoned.

The present invention relates to fuels for power engines and, more particularly, to the improvement in fuels for internal combustion engines.

Internal combustion engines, in particular the OTTO engine and the diesel engine, and recently also the so-called rotative piston engine (Wankel engine), are known. It is further known that they are fed with combustible fuels which may be classified as carburetor fuels and injection fuels. This classification is not a fully strict one since, recently, some OTTO engines are provided with fuel injection.

As fuels for internal combustion engines, hydrocarbon fractions are used which are obtained from crude oil and which have generally undergone a refining and/or chemical transformation process, like reforming, hydroforming, platforming, etc. These fuels contain certain additives which are believed to improve their properties. The most important additives are the following:

1. anti-knocks, especially tetraethyl lead (TEL);
2. scavengers to avoid deposits in the engine combustion chamber, like ethylene dibromide and dichloride, and deposit modifiers, like esters of phosphoric and boric acids, silicon compounds, and sulfur and chlorine substituted phosphorus compounds;
3. antioxidants against polymerization of unsaturated fuel components, like aromatic amines or phenols, and metal inactivators like derivatives of the salicyl aldehyde, and
4. carburetor anti-freezes, e.g. lower alkohols, ethylene glycol and higher glycols.

The term "fuel" as used herein will mean the above defined hydrocarbon based liquids, with or without the cited additives. This term further comprises such liquid hydrocarbon fractions containing variable amounts of dissolved normally gaseous hydrocarbons (like butanes) and/or other organic liquids like ethanol, acetone, etc.

The fuel must be fed to the engine in finely divided state. To this purpose, the liquid fuel is atomized in the carburetor or in the injection nozzle. At the same time, a certain degree of vaporization is obtained in the carburetor. In any case, the finely divided fuel is an aerosol, i.e. a dispersion of droplets in air or in a mixture of air and hydrocarbon vapors.

The fine division is achieved by mechanical forces, namely in the carburetor by air which is streaming about the carburetor nozzle with a high speed, or by a high hydraulic pressure in injection. These kinds of atomization are principally known (see P. Grassmann, Physikalische Grundlagen der Chemie-Ingenieur-Technik, Aarau 1961, pages 346 to 356 and 770 to 780). It results from calculations that the diameter of produced drops is inversely proportional to the surface tension of a given liquid, the work of division being preselected and held constant, and the other conditions being held constant too.

It has been known for a long time that the exhaust gases of combustion engines contain a plurality of undesired component which charge and contaminate the environmental atmosphere. Due to the tremendous increase in motorization, the exhaust purification has become a serious problem which must be resolved in the very near future.

The most important components of the engine exhausts, in terms of noxiousness, are the products of an incomplete combustion, in particular unburned or only partially burned (oxidized) hydrocarbons, and carbon monoxide. It is principally impossible to reduce the CO concentration in the exhaust gases to 0% during normal fuel combustion due to the thermal $CO_2$ reactions $2\ CO_2 \rightarrow 2\ CO + O_2$ and $CO_2 + C \rightarrow 2\ CO$ and the water gas equilibrium ($CO_2 + H_2 \rightleftarrows CO + H_2O$) since no substantial excess of air is present and, when the stoichiometric $CO/O_2$ ratio is considered, already nearly 10% of the $CO_2$ decomposes to CO and $O_2$ at 2200° C. A substantial improvement may be obtained when the combustion temperature, the flame temperature in the engine, could be lowered to about 1700° C where only 1% of the $CO_2$ decomposes; at such a lowered temperature, the water gas equilibrium is also better on the side of $CO_2$. But in practice, the combustion temperature in the OTTO engine is between 2000° and 2500° C, and in the diesel engine between 1400° and 2000° C. The lower combustion temperature and the higher pressure in the diesel engine contribute to the fact that correctly timed and controlled diesel engines are to be preferred in terms of exhaust gas purity.

Furthermore, the discussion above refers to a stoichiometric intake air-fuel ratio; in practice, however, the engines are rather set to conditions with excess fuel in order to increase the engine power.

In the last years, suggestions have been made to decontaminate the exhaust gases; however, all these suggestions are related to a post-treatment of these gases, e.g. catalytic post-combustion. It is further known to electronically control fuel injection in order to optimize the fuel feed responsive to any given engine operation state. But here again, expensive additional devices and parts are necessary requiring proper maintenance and being little reliable.

It has been known for a long time that carburetion engines are especially dirty during idling, where the air speed in the carburetor is comparatively low. This is, to some extent, also true for the diesel engine. On the other hand, it has been noticed that engines fed with droplet free fuel, i.e. completely gaseous one like propane, butane etc., give especially clean exhaust gases during idling. Therefore, good results should be obtained if it were possible to totally vaporize the fuel before its entry into the combustion chamber. However, this is only possible with expensive, power consuming devices and by additionally re-constructing the mixing apparatus for fuel and air and the dosage devices; furthermore, a fuel vapor loader or compressor would be required.

It is therefore an object of the present invention to provide a liquid fuel for internal combustion engines which, when fed into the engine, will result in a combustion giving less amounts of noxious gases as CO, nitrogen oxides (generally designed as $N_xO_y$, $x$ and $y$ being positive numbers), unconsumed hydrocarbons and cancerogenic substances.

A further object of the instant invention is to provide a liquid fuel which will give the mentioned results without any or, at the most, with only insignificant changes in the intake manifold system including the carburetor and the injection system, the engine itself and its exhaust system.

Still a further object of the present invention is to provide a liquid fuel which is capable of decreasing the combustion temperature and of rendering the engine strokes smoother, without any noticeable loss in engine power.

Still a further object of this invention is to provide a liquid fuel which allows a reduction in consumption without any noticeable loss in engine power.

These and other objects of the invention are accomplished by the novel fuel of the invention which contains as an additive at least one substance capable of reducing the surface tension of the fuel without this additive. This fuel is therefore characterized by the fact that its surface tension is lower than that of ordinarily used liquid fuels.

According to the invention, the fuel contains at least one substance which lowers the surface tension of the basic fuel. Such substances are commonly known as "tensides" or "surfactants" (surface active agents). It is a particularity of such substances to accumulate at least partially in the surface of a liquid where they lower the free surface energy against the surrounding air or air-vapor mixture respectively. Such substances are well known, e.g. aqueous detergent compositions where they lower the surface tension of water and therefore give a spreading, penetrating, and dispersing effect. This behaviour of surfactants is due to the fact that they contain in their molecule a solvophilic moiety retaining them in the liquid dissolving medium, and a solvophobic moiety which tends to push the molecule out of the solvent phase.

The surface tension of a liquid is measured in dyn/cm and the free surface energy in erg/cm$^2$, the numerical values being the same.

It has already been proposed to add surfactants to fuels. However, these surfactants were corrosion inhibitors, e.g. anion active or cation active substances like long-chain carboxylic acids, amines, petroleum sulfonates, amine sulfonates amine phosphates etc; anti-deposits against the deposit of residues in the carburetor, like fatty acid polyamides and fatty acid amines; and anti-freezing agents like amine salts of phosphoric acid esters, fatty acid esters of polyalcohols, etc. All these substances which were proposed and used only lower the surface tension of aqueous systems and may act as emulsifiers but are not active for the purpose of the invention.

In the present invention, only such substances can be used as additives which lower the surface tension of hydrocarbons, especially hydrocarbon fractions from mineral oil, being the major part of fuels like gasoline (petrol) and diesel fuel. These substances are preferably nonionic or at most weakly ionic tensides. They should be soluble in the fuels and give stable solutions therewith.

Examples for substances which are sufficiently lipophilic to give stable solutions in fuels and which are capable of lowering the surface tension thereof, are especially the following groups:

1. alkanolamine soaps of fatty acids wherein the alkanol moiety may be ethoxylated and or propoxylated, or be substituted, e.g. by aryl, like mono, di or triethanolamine oleate, stearate, ricinoleate, palmitate, myristate, arachidate, α-hydroxystearate, etc, preferably triethanolamine stearate and oleate;
2. alkanolamine alkylbenzene and alkylnaphthalene sulfonates wherein the alkanolamine moiety may be ethoxylated and/or propoxylated, and the alkyl moiety bonded to the aryl nucleus may comprise from 8 to 16 carbon atoms; the monoethanolamine salts of the decyl, dodecyl and tetradecylbenzene sulfonic acids being preferred;
3. Sodium, potassium and ammonium salts of dialkyl succinate sulfonic esters ("dialkyl sulfosuccinates"), and alkylamine and hydroxyalkylamine salts thereof; preferred are salts of acids which are twice esterified with $C_4$ to $C_8$ alcohols, e.g. diheptyl succinate sodium sulfonate;
4. alkyl polyglycol ethers, polyglycol ethers as "Oxydwachs 1500", and ethoxylated alkylphenols and alkylnaphtols;
5. mono- and disaccharide alcohol esters like monosorbitol laurate, palmitate, stearate and oleate, and trisorbitol esters of these acids.

In order to ascertain and to evaluate the surfactant properties and activities of a tenside in the invention, a simple test is sufficient. For example, first conventional fuel is withdrawn dropwise from a burette, and the drops are counted for a given volume. Then, the fuel is assayed at the same manner and under the same conditions but containing the additive to be tested. The higher the number of drops for the same volume, the more active is the additive.

The amounts of the tenside to be added to the fuel may vary considerably, depending from the nature and characteristics of the tenside, from synergistic effects of tenside mixtures, and from the effect to be obtained. However, they will be between 0.01 and 10% by weight, preferably between 0.05 and 5%, especially between 0.08 and 2.5%. Within these concentration limits, an appropriate tenside which is sufficiently soluble in hydrocarbons will not deposit in the fuel tank, in motor parts, in the carburetor or injector nozzles. For more security against deposits, especially at very low temperatures, normally liquid or pasty additives will preferably be selected, and no deposit has been observed with such additives at very low temperatures (to −40° C) at concentrations between 0.5 and 5% by weight.

Solubility enhancers may be used wherein the particular tenside is first dissolved, and the thus obtained solution is then in corresponding amounts added to the fuel. The solution enhancer should be fully soluble in fuels. For example, a tenside which is not easily soluble in hydrocarbon fuels may first be dissolved in an alcohol, a ketone, an ester or an aryl hydrocarbon as benzene, to a concentration of, say, 10, 20 or 40% by volume or by weight, and this merely concentrated standard or base solution may then be used as the additive. Of course, the solvents used should be combustible in the engine.

The particular tenside to be used as an additive should not contain appreciable amounts of water since, in this case, the water will precipitate in the fuel and make it turbid. However, most of the commercially available tensides are substantially anhydrous substances, especially the nonionics.

The tensides to be used in the invention should be composed of a compact lipophilic moiety, which ascertains a good solubility in the fuel, and a rather long-chain hydrophilic (or lipophobic) moiety which ascertains the accumulation of the tenside at the fuel-air interface and which render the particular tenside surface active in fuels. In the practice of surfactants, the so-called HLB value (hydrophilic lipophilic balance) is used to design the tenside characteristics of a surfactant (see, W. D. Griffin, J.Soc. Cosmetic. Chem. 5 (1954), 249). This HLB value is defined as $$HLB = 20(1 - \frac{L}{H - L})$$

wherein $H$ is the weight of the hydrophilic moiety of a molecule and $L$ the lipophilic one. From this equation, one should expect that surfactants having a HLB in the range of 1 to 10, i.e. wherein the lipophilic moiety accounts for 95 to 50% by weight of the molecule, would be the most active ones for the purpose of the invention. However, it has surprisingly be found that some surfactants having a HLB value of from 11 to 15 (45 to 25% by weight lipophilic) were considerably active when the lipophilic moiety was very compact and chemically similar to the main fuel constituants, e.g., polyoxyethylated alkyl phenols with from 7 to 15, in some cases to 30, oxyethylene units.

Surfactants with still higher HLB values may advantageously be used, and when their solubility in fuels is not sufficient, they may be mixed with a chemically similar surfactant having a lower HLB value and being perfectly soluble in fuels. Thus, outstanding results were obtained with a polyoxyethylene alkyl phenol having 30 oxyethylene units and a HLB value of 18, in mixture with equal parts of such an alkyl phenol having 5 oxyethylene units and a HLB value of 10. The novel additive may be added, in substance or in the form of standard or basic solutions, to the fuel at any stage of the production and distribution chain, i.e. in the refinery, at the wholesale dealer, at the gas station or by the engine driver, before, during or after fueling. A particularly good distribution of the additive in the fuel is obtained when it is used in the form of a basic solution at a concentration of, say, about 20 or 30%.

The surface tension of fuels for internal combustion engines is per se very low and amounts to about 19 to about 24 dyn/cm for carburetor fuels and to about 23 to about 33 dyn/cm for diesel fuels, at 20° C. It could not be expected that a further reduction of the surface tension would give the advantages discussed below.

It has been found by measures that already very low amounts of additives reduce the surface tension of the fuel. When higher amounts are added, the reduction obtained goes slower, and the surface tension will become a minimum. This is the case when the fuel contains from about 10 to 25% of additive, depending from its particular nature. With greater amounts of additive, the surface tension will now rise, and at the same time, the viscosity of the mixture will rise. Therefore, the amount of additive should generally not exceed 10%.

The advantages which were observed were the following

1. Smoother combustion. This may be stated especially on engines running with too little advance ignition or with retarded ignition. It is believed — without being bound by this theory — that the flame front spreads more rapid and more uniform in the combustion chamber, and therefore the overall combustion is "smoother" but with somewhat increased speed. This fact results in a power increase of the engine since the combustion seems to be substantially complete immediately before the beginning of the exhaust stroke. In contrast thereto, conventional fuels without the additive of the invention produce nummerous products of partial combustion.

When this advantage of the fuel of the invention is to be used to an optimal extent, it is recommended to reduce the advance of ignition which is a very simple measure.

2. Purity of exhaust gases. Due to the more complete combustion of the fuel with additive, the exhaust gases are generally free from unconsumed hydrocarbons and substantially free from partial combustion products. In particular, the CO concentration in the exhaust gases is drastically reduced since the water gas equilibrium is better approximated in the combustion chamber, and it will assume values which are near to the equilibrium ones dictated by temperatures and concentrations (see Examples). Furthermore, the combustion temperature in the engine is lowered which fact contributes to the lowering of the CO concentration.

3. Management of the engine. The more uniform combustion reduces mechanical shocks in the transmission means and devices, the lower combustion temperature results in lower wear and a lower stress of the lubricating oil film, thus better lubricating performances.

4. Reduction in fuel consumption. The better fuel utilization results in fuel savings which generally amount with 10g of additive per liter of fuel (about 1.3% by weight) to about 8 to 12%. If the price of 1 kg of additive is Sfrs. 2.- and of 1 liter of gasoline is Sfrs 0.75, the average savings are Sfrs. 0.075 per liter fuel. This kind of "exhaust gas purification" of the invention shows therefore financial (and thus economical) savings instead of additional expenses. If the power of the engine is to be held constant, the main nozzle of the carburetor may be changed against a smaller one or the stroke of the injector may be shortened. These measures contribute also to a better atomisation of the fuel.

It has been found that the reduction of the surface tension resulting from the additive leads to a better atomisation of the fuel, and the amount of relatively coarse droplet in the atomized fuel is reduced. Furthermore, the amount of very fine droplets is also reduced. The invention therefore permits a very much more uniform droplet size distribution in the sprayed fuel which seems to be the cause of the more rapid and more uniform combustion in the engine as well as of the lower combustion temperature.

It has also been found that the additive of the invention does by no means adversely affect the properties and effects of the other ones conventionally used in fuels. It does not cause corrosion either in the exhaust system or in the tank and carburetor or in the engine.

The following Examples are illustrative only and are not construed to limit the invention.

EXAMPLE I

In a glass-stoppered bottle, 100 ml of an ethoxylated alkyl phenol having an average of 4.6 oxyethylene groups and a HLB value of about 10, were shaken at room temperature with 400 ml of premium grade gasoline. In a few seconds, a slightly foaming uniform solution is formed containing 20% by volume of the surfactant. This standard solution was used in further tests (see below).

EXAMPLE II

In a glass-stoppered bottle, 80 ml of an ethoxylated alkyl phenol having an average of 15 oxyethylene groups and a HLB value of about 15, were shaken at 25° C with 400 ml of premium grade gasoline. On standing, two layers are formed, the lower of which was about 60 ml of separated additive. To the bottle, 20 ml of an ethoxylated alkyl phenol having about 5 oxyethylene groups and a HLB value of about 10, were added. On shaking, a homogeneous mixture was formed immediately which was stable at all temperatures (lowest temperature tested was −30° C). The additive mixture has a calculated HLB value of about 14. This standard solution (20% by volume of additive) was used in further tests.

EXAMPLE III

By the method described in Example II, but using a temperature of about 35° C, a 20% by volume standard solution was prepared containing, in one liter of mixture, 160 ml of a surfactant of HLB 17 and 40 ml of a surfactant of HLB 10. The calculated HLB value of the additive mixture was about 15.6.

EXAMPLE IV

In order to show the influence of increasing concentration of an additive on the CO concentration in exhaust gases, a series of tests has been made. The standard solution of Example I was used as additive.

Four fuels were prepared containing, by volume, 0.25%, 1%, 5% and 10%, respectively, of the additive used in Example I. For example, when 50 ml of the standard solution of Example I are mixed with 950 ml of gasoline, one liter of fuel is obtained having a 1% concentration of additive.

The fuel pump of a Renault R4 car was connected to a glass bottle containing the fuel to be tested. When the engine had exhausted the carburetor contents, the fuel to be tested was allowed to be pumped into the carburetor. When about 100 ml of fuel had been consumed, the concentration of CO in the exhaust gases was measured with a continuous BOSCH CO testing apparatus. The setting of the carburetor and of the ignition was not changed.

The following results have been obtained (Table I):

TABLE I

| Test No | Fuel | CO in exhaust gases, % by volume idling (ab. 1000 rpm) | charge (ab. 3000 rpm) |
|---|---|---|---|
| 1 | normal grade gasoline | 9.0–9.5 | 5.5 |
| 2 | premium grade gasoline | 9.5–10.0 | 5.5 |
| 3 | premium+0.25% additive by vol. | 7.5 | 5.0 |
| 4 | premium+1.0% additive by vol. | 7.0 | 4.5 |
| 5 | premium+5.0% additive by vol. | 6.0 | 3–4 |
| 6 | premium+10.0% additive by vol. | 2.5–3 | 1.5 |

The reduction in CO concentration was about 70% of the original value on idling and about 73% under normal driving conditions.

EXAMPLE V

The method of Example IV was repeated with the exception that other additives from the group of ethoxylated alkyl phenols were used. Additive B has 8 oxyethylene groups per molecule and a HLB value of 12.5 and additive C has 9 oxyethylene groups and a HLB value of 13. Both additives were perfectly soluble in gasoline. In the tests, premium grade gasoline (octane number 98–100) was used, and the engine carburetor was set with fuel not containing the additives to the minimum of CO concentration in the exhaust.

The following results were obtained (Table II):

TABLE II

| Test No | Fuel | CO in exhaust gases, % by volume idling (ab. 1000 rpm) | charge (ab. 3500 rpm) |
|---|---|---|---|
| 1 | gasoline | 5.8–6 | 3.8–4.0 |
| 2 | gasoline+1% additive B | 3.5–3.8 | 2.0 |
| 3 | gasoline+2.5% additive B | 0.2–0.4 | 1.2–1.4 |
| 4 | gasoline+1% additive C | 3.4–3.7 | 2.0 |
| 5 | gasoline+2% additive C | 0.6–0.8 | 1.2–1.4 |
| 6 | gasoline+5% additive C | 0.4–0.5 | 1.0–1.2 |

Furthermore, the $NO + NO_2$ concentration was measured with Draeger testing tubes giving 1000 ppm in test 1 and 1000 ppm in test 3.

Additives B and C, as can be seen from the table, give significant reductions of the CO content (a 95% reduction in test 3) by using relative minute amounts of additive. The $NO + NO_2$ concentration is not increased as in previous attempts to lower the CO concentration, as by injection of water vapor into the working cylinder, or by admitting air-to-fuel ratios substantially greater than unity.

The results are also insofar very interesting in that the idling engine is particularly contaminant with a fuel without additive, and the latter especially reduces the CO concentration during idling.

EXAMPLE VI

In this Example, additive D is used in the method of Example V. Additive D is that of Example II. The results are compiled in Table III. Premium grade gasoline was used. The percentual values of additive added refer to the gasoline free mixture of the two substances of Example III.

In this Example, good results are already achieved with 0.5 to 1.0% by volume of the additive.

TABLE III

| Test No | Fuel | CO in exhaust gases, % by volume idling (ab. 1000 rpm) | charge (ab. 3500 rpm) |
|---|---|---|---|
| 1 | gasoline | 5.8–6 | 3.8–4.0 |
| 2 | gasoline+0.5% additive D | 0.6–0.8 | 1.2–1.4 |
| 3 | gasoline+1.0% additive D | 0.2–0.4 | 1.2–1.4 |
| 4 | gasoline+2.0% additive D | 0.2–0.4 | 1.0–1.2 |

It will be appreciated that the foregoing is a description of representative embodiments of the instant invention. This is for illustrative purposes only and the present invention is not to be limited thereby but only by the claims wherein

What is claimed is:

1. A liquid carburetor gasoline composition for internal combustion engines having improved combustion properties and reduced emission of carbon monoxide in the exhaust gases from the engine containing dissolved therein a surface tension lowering amount of 0.5 to 5% by volume of at least one tenside additive capable of lowering the surface tension of said fuel.

2. The composition of claim 1 wherein said additive is a surface active substance having in its molecule a lipophilic fuel soluble moiety and a lipophobic moiety.

3. The composition of claim 1 wherein said additive is a polyglycol ether of an alkylphenol having in its molecule from 4 to 9 oxyethylene units and from 6 to 16 carbon atoms in the alkyl chain or chains.

4. The composition of claim 1 wherein said additive is a polyglycol ether of an alkylphenol having from 5 to 15 oxyethylene units in its molecule and from 6 to 16 carbon atoms in the alkyl chain or chains.

5. The composition of claim 1 wherein said additive is a mixture of surface active substances having different lipophilic-lipophobic balances of the corresponding lipophilic and lipophobic moieties in the respective molecules.

6. The composition of claim 2 wherein said surface tension reducing amount is 1–5% by volume.

7. The composition of claim 1 wherein said additive has an HLB value of 2–15 when a single additive is employed and a calculated HLB value of 10–18 when a mixture of additives is employed.

8. The composition of claim 1 wherein said additive is ionic.

9. The composition of claim 1 wherein said amount is 2–5% by volume.

10. The composition of claim 1 wherein said additive is selected from the group consisting of alkanolamine soaps of fatty acids, alkanolamine alkylbenzene or alkylnapthalene sulfonates, dialkyl sulfosuccinates and the alkylamine and hydroxyalkylamine salts thereof, and saccharide esters of alcohols.

* * * * *